US011480378B2

(12) United States Patent
Wantland et al.

(10) Patent No.: US 11,480,378 B2
(45) Date of Patent: Oct. 25, 2022

(54) REFRIGERATOR APPLIANCE ICE STORAGE BIN WITH A KICK PLATE

(71) Applicant: Haier US Appliance Solutions, Inc., Wilmington, DE (US)

(72) Inventors: Louis A. Wantland, Louisville, KY (US); Bradley Nicholas Gilkey, Louisville, KY (US); Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 166 days.

(21) Appl. No.: 16/780,950

(22) Filed: Feb. 4, 2020

(65) Prior Publication Data

US 2021/0239379 A1 Aug. 5, 2021

(51) Int. Cl.

| | |
|---|---|
| ***F25C 5/20*** | (2018.01) |
| ***F25C 5/182*** | (2018.01) |
| ***F25D 11/02*** | (2006.01) |

(52) U.S. Cl.

CPC ..... *F25C 5/24* (2018.01); *F25C 5/182* (2013.01); *F25C 5/22* (2018.01); *F25D 11/02* (2013.01)

(58) Field of Classification Search

CPC .... F25C 5/22; F25C 5/182; F25C 5/24; F25C 2500/08; F25C 1/147; F25D 11/02

See application file for complete search history.

(56) References Cited

U.S. PATENT DOCUMENTS

| | | | | |
|---|---|---|---|---|
| 4,181,244 | A | 1/1980 | Karlovits | |
| 4,525,073 | A * | 6/1985 | Spinner | F25C 1/147 366/323 |
| 4,641,763 | A * | 2/1987 | Landers | B67D 1/0857 222/129.1 |
| 4,676,405 | A * | 6/1987 | Lents | F25C 5/24 222/108 |
| 7,984,622 | B2 | 7/2011 | Yoon et al. | |
| 2008/0156023 | A1* | 7/2008 | Kim | F25C 5/22 62/344 |

FOREIGN PATENT DOCUMENTS

| | | | |
|---|---|---|---|
| JP | 10038427 | A * | 2/1998 |
| KR | 20080020900 | A | 3/2008 |
| KR | 101560171 | B1 | 10/2015 |

OTHER PUBLICATIONS

JP-10038427-A translation.*

* cited by examiner

*Primary Examiner* — Elizabeth J Martin

(74) *Attorney, Agent, or Firm* — Dority & Manning, P.A.

(57) ABSTRACT

A refrigerator appliance includes a cabinet, a door, and an ice bin. The ice bin may be removably received within a chilled chamber and include a bin body and a non-vertical auger. The bin body may define a storage volume to receive ice therein and a dispenser opening in fluid communication with the storage volume. The non-vertical auger may include a rotation shaft extending along a rotation axis and a cam disposed on the rotation shaft. The ice bin may include a kick plate within the storage volume. The cam on the non-vertical auger may actuate the kick plate.

18 Claims, 15 Drawing Sheets

REFRIGERATOR APPLIANCE ICE STORAGE BIN WITH A KICK PLATE

FIELD OF THE INVENTION

The present subject matter relates generally to assemblies for storing and dispensing ice, and more particularly to ice bin assemblies for use in refrigerator appliances.

BACKGROUND OF THE INVENTION

Certain refrigerator appliances include an ice maker. In order to produce ice, liquid water is directed to the ice maker and frozen. A variety of ice types can be produced depending upon the particular ice maker used. For example, certain ice makers include a mold body for receiving liquid water (e.g., to be frozen and formed as ice nuggets). An agitator or auger within the mold body can rotate and scrape ice off an internal surface of the mold body to form ice nuggets or cubes. Once ice is scraped off the mold body, it may be stored within an ice bin or bucket within refrigerator appliance. In order to maintain ice in a frozen state, the ice bin is positioned within a chilled chamber of the refrigerator appliance or a separate compartment behind one of the doors. In some appliances, a dispenser is provided in communication with the ice bin to automatically dispense a selected or desired amount of ice to a user (e.g., through a door of the user appliance). Typically, a rotating agitator or sweep is a provided within the ice bin to help move ice from the ice bin to the dispenser.

Although delivery of ice through, for example, a door of a refrigerator appliance may be useful, existing systems present a number of problems. As an example, it may be difficult to see ice within the ice bin. As another example, there may be instances when a user may wish to remove an ice bin from the refrigerator appliance. However, removal of an ice bin can be difficult and cumbersome in many existing appliances. If an agitator or sweep is provided, it may be difficult to remove or manage the rotating agitator or sweep within an ice bin. Ice may periodically melt and refreeze within the ice bin, making it especially difficult to remove or rotate the sweep or agitator. Ice may melt and refreeze, clumping together as an undesirable mass. In some existing appliances, a top opening of the ice bin (e.g., through which ice falls into the ice bin from the ice maker) must be kept relatively small so that the sweep or agitator can be supported at a top portion of the ice bin. Furthermore, a motor may be provided to drive the sweep or agitator. It may be difficult, however, to arrange the motor and agitator connection in such a way that does not further restrict access to the ice bin or a user's ability to remove the ice bin from the refrigerator appliance.

As a result, there is a need for an improved refrigerator appliance or ice bin assembly. In particular, it would be advantageous to provide a refrigerator or ice bin assembly addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, and an ice bin. The cabinet may define a chilled chamber. The door may be rotatable between an open position permitting access to the chilled chamber and a closed position restricting access to the chilled chamber. The ice bin may be removably received within the chilled chamber. The ice bin may include a bin body and a non-vertical auger. The bin body may define a storage volume to receive ice therein. The bin body may extend along a vertical direction between a top end and a bottom end. The bin body may further define a dispenser opening in fluid communication with the storage volume at the bottom end to selectively permit ice therefrom. The non-vertical auger may define a rotation axis within the storage volume to direct ice within the storage volume to the dispenser opening. The non-vertical auger may include a rotation shaft extending along the rotation axis and a cam disposed on the rotation shaft. The ice bin may further include a kick plate hingedly mounted within the storage volume. The cam of the non-vertical auger may actuate the kick plate In another exemplary aspect of the present disclosure, an ice bin for a refrigerator appliance is provided. The refrigerator appliance may include a cabinet, a door, and an ice bin. The cabinet may define a chilled chamber. The door may be rotatable between an open position permitting access to the chilled chamber and a closed position restricting access to the chilled chamber. The ice bin may be configured to be removably received within the chilled chamber. The ice bin may include a bin body, a non-vertical auger, and a kick plate. The bin body may define a storage volume to receive ice therein. The bin body may extend along a vertical direction between a top end and a bottom end. The bin body may further define a dispenser opening in fluid communication with the storage volume at the bottom end to selectively permit ice therefrom. The non-vertical auger may define a rotation axis within the storage volume to direct ice within the storage volume to the dispenser opening. The non-vertical auger may include a rotation shaft extending along the rotation axis and a cam disposed on the rotation shaft. The kick plate may be hingedly mounted within the storage volume such that the cam of the non-vertical auger actuates the kick plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
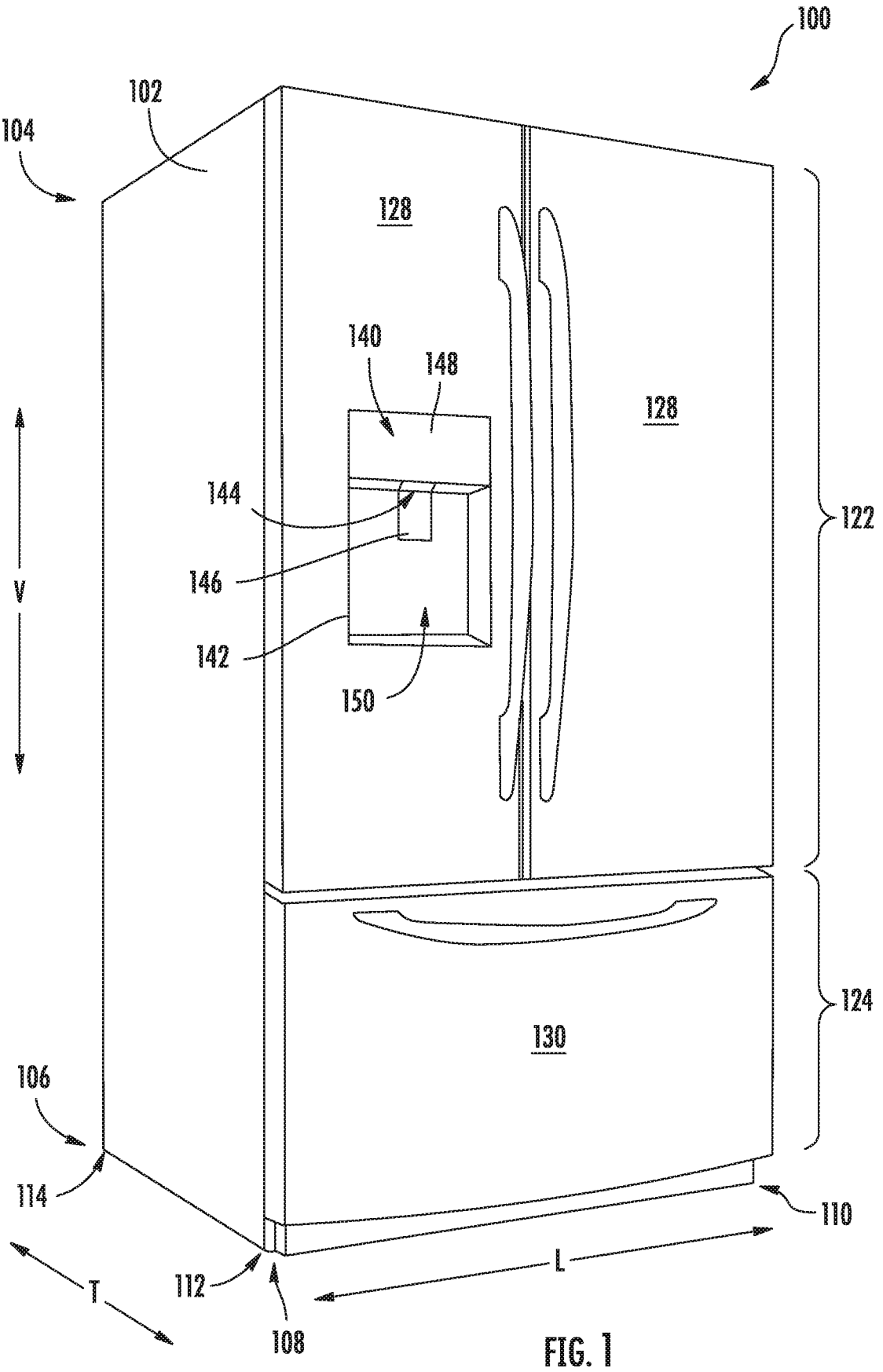
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
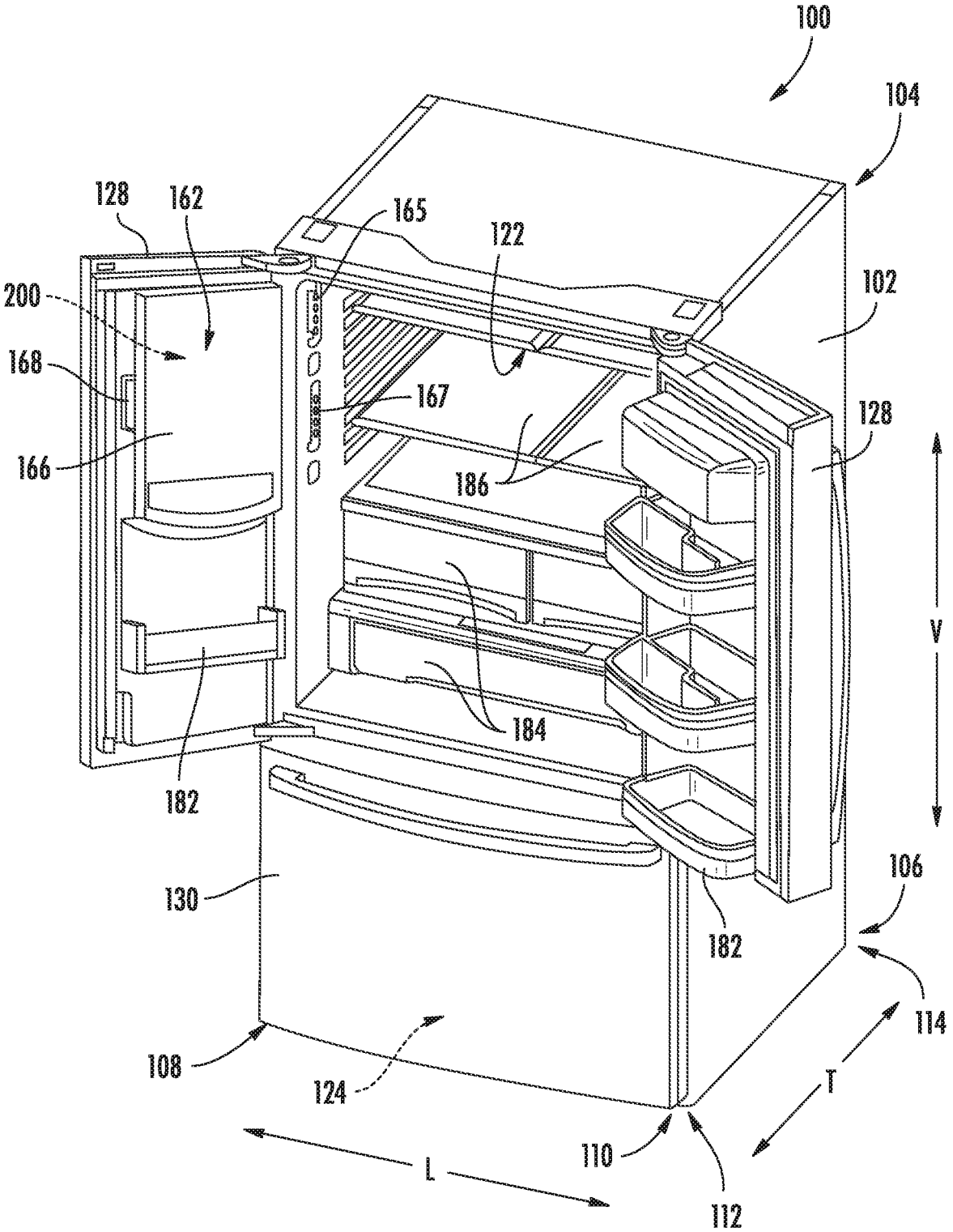
FIG. 2 provides a perspective view of a door of the example refrigerator appliance of FIG. 1.
Figure 3:
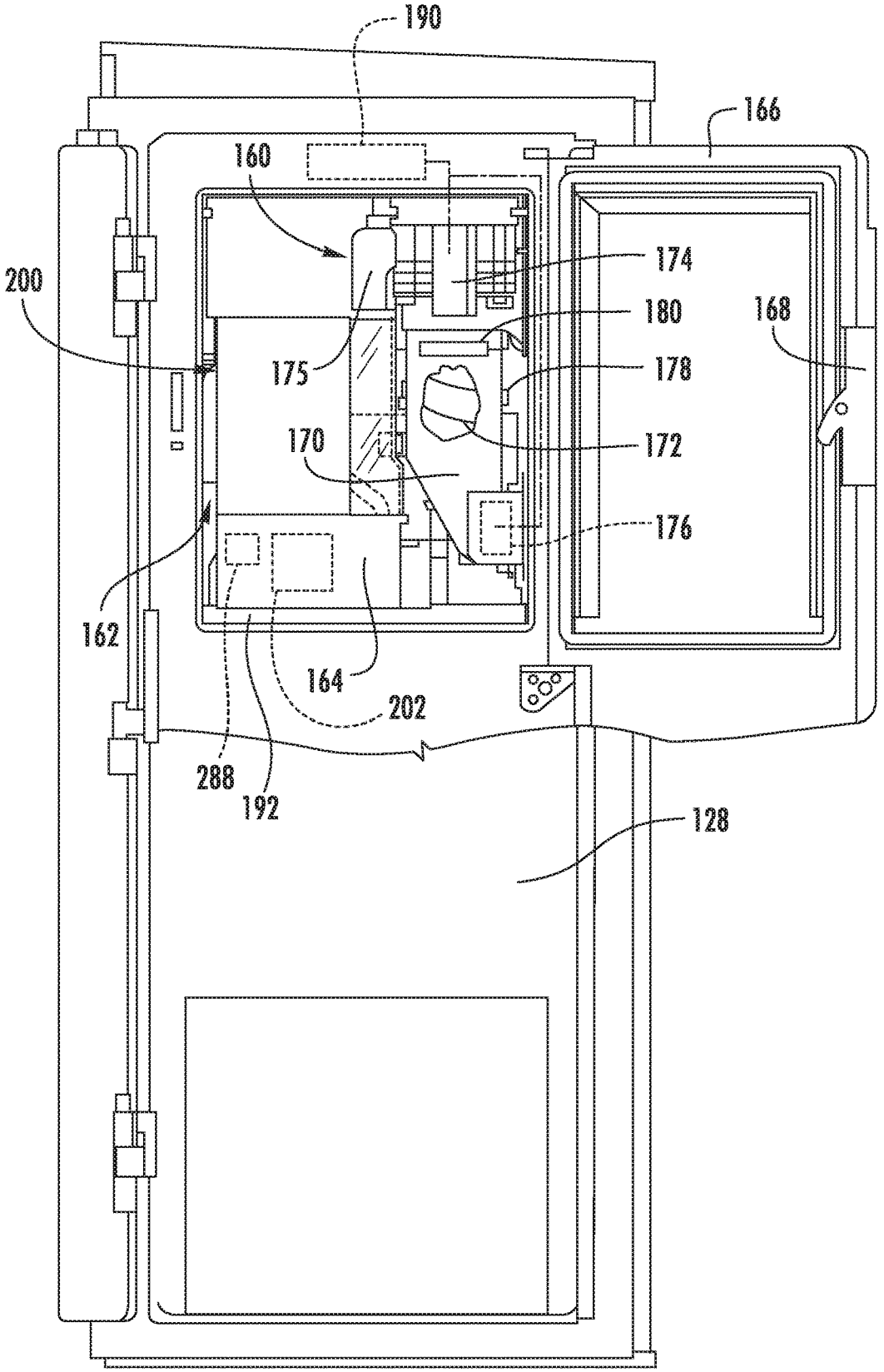
FIG. 3 provides an elevation view of the door of the exemplary refrigerator appliance of FIG. 2 with an access door of the door shown in an open position.

Turning now to the figures, FIGS. 1 and 2 provide perspective views of a refrigerator appliance (e.g., refrigerator appliance 100) according to an exemplary embodiment of the present disclosure. FIG. 3 provides an elevation view of a refrigerator door 128 with an access door 166 shown in an open position.

As shown, refrigerator appliance 100 includes a cabinet or housing 102 that extends between a top 104 and a bottom 106 along a vertical direction V, between a first side 108 and a second side 110 along a lateral direction, and between a front 112 and a back 114 along a transverse direction T. Housing 102 defines one or more chilled chambers for receipt of food items for storage. In some embodiments, housing 102 defines fresh food chamber 122 positioned at or adjacent top 104 of housing 102 and a freezer chamber 124 arranged at or adjacent bottom 106 of housing 102. As such, refrigerator appliance 100 may generally be referred to as a bottom mount refrigerator.

It is recognized, however, that the benefits of the present disclosure apply to other types and styles of refrigerator appliances such as, for example, a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, various storage components are mounted within fresh food chamber 122 to facilitate storage of food items therein, as will be understood art. In particular, the storage components include storage bins 182, drawers 184, and shelves 186 that are mounted within fresh food chamber 122. Storage bins 182, drawers 184, and shelves 186 are configured for receipt of food items (e.g., beverages or solid food items) and may assist with organizing such food items. As an example, drawers 184 can receive fresh food items (e.g., vegetables, fruits, or cheeses) and increase the useful life of such fresh food items.

In some embodiments, refrigerator appliance 100 also includes a dispensing assembly 140 for dispensing liquid water or ice. Dispensing assembly 140 includes a dispenser 142, for example, positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In exemplary embodiments, dispenser recess 150 is positioned at a level that approximates the chest level of a user.

In some embodiments, refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. Although sub-compartment 162 is shown in door 128, additional or alterative embodiments may include sub-compartment 162 fixed within fresh food chamber 122.

In exemplary embodiments, an ice maker or ice making assembly 160 and an ice storage bin 164 (FIG. 3) are positioned or disposed within sub-compartment 162. For instance, ice making assembly 160 may be positioned, at least in part, above ice storage bin 164, which may be selectively mounted on a supporting surface 192 (e.g., defined by an inner wall of door 128). During use, ice is supplied to dispenser recess 150 (FIG. 1) from the ice making assembly 160 or ice storage bin 164 in sub-compartment 162 on a back side of refrigerator door 128.

In additional or alternative embodiments, chilled air from a sealed system (not shown) of refrigerator appliance 100 may be directed into components within sub-compartment 162 (e.g., ice making assembly 160 or storage bin 164 assembly). For instance, sub-compartment 162 may receive cooling air from a chilled air supply duct 165 and a chilled air return duct 167 disposed on a side portion of cabinet 102 of refrigerator appliance 100. In this manner, the supply duct 165 and return duct 167 may recirculate chilled air from a suitable sealed cooling system through icebox compartment 160. An air handler (e.g., fan 176—FIG. 3), such as a fan or blower, may be provided to motivate and recirculate air. As an example, the air handler can direct chilled air from an evaporator of a sealed system through a duct to sub-compartment 162.

Figure 4:
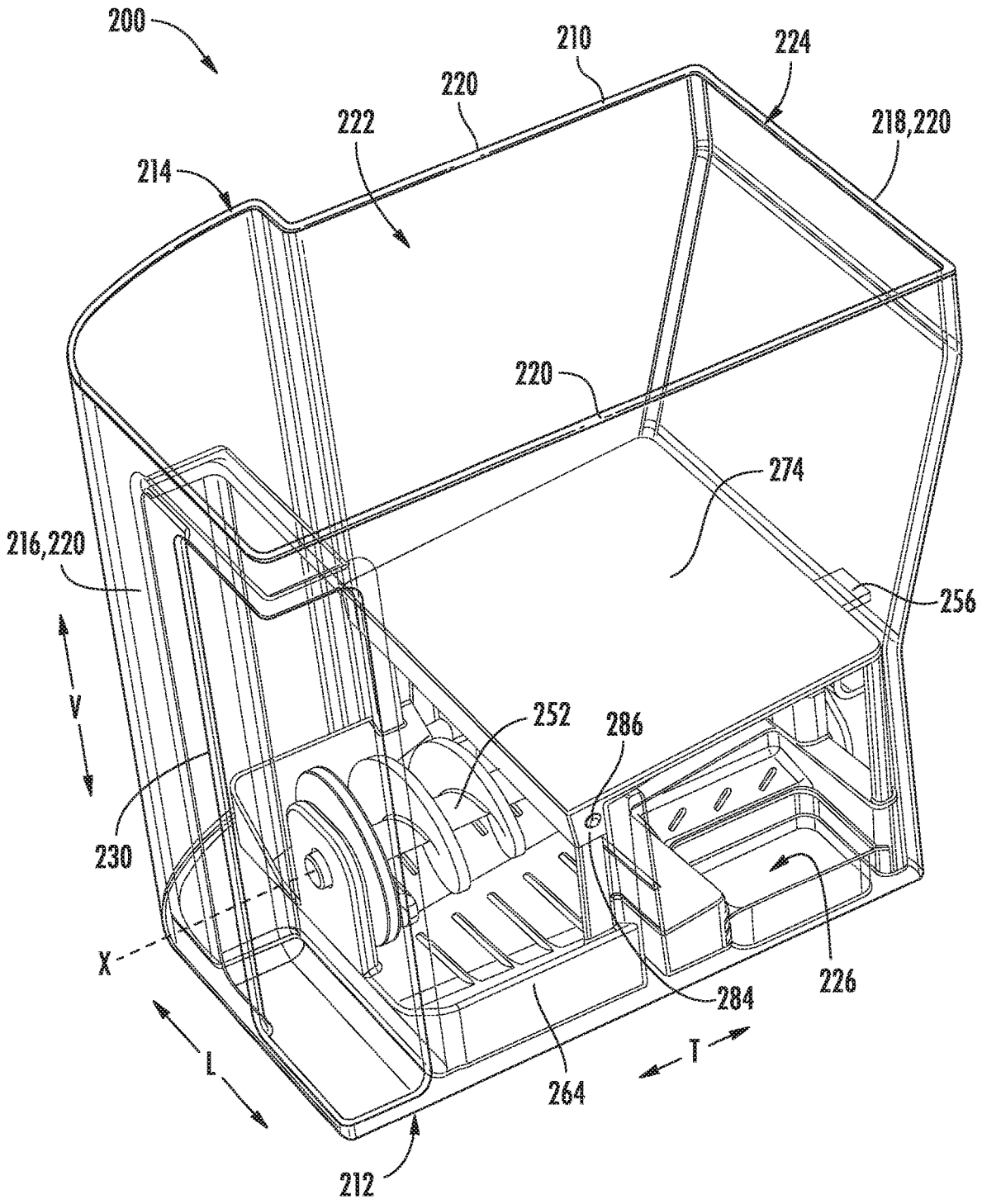
FIG. 4 provides a perspective view of a bin assembly for a refrigerator appliance according to exemplary embodiments of the present disclosure.
Figure 5:
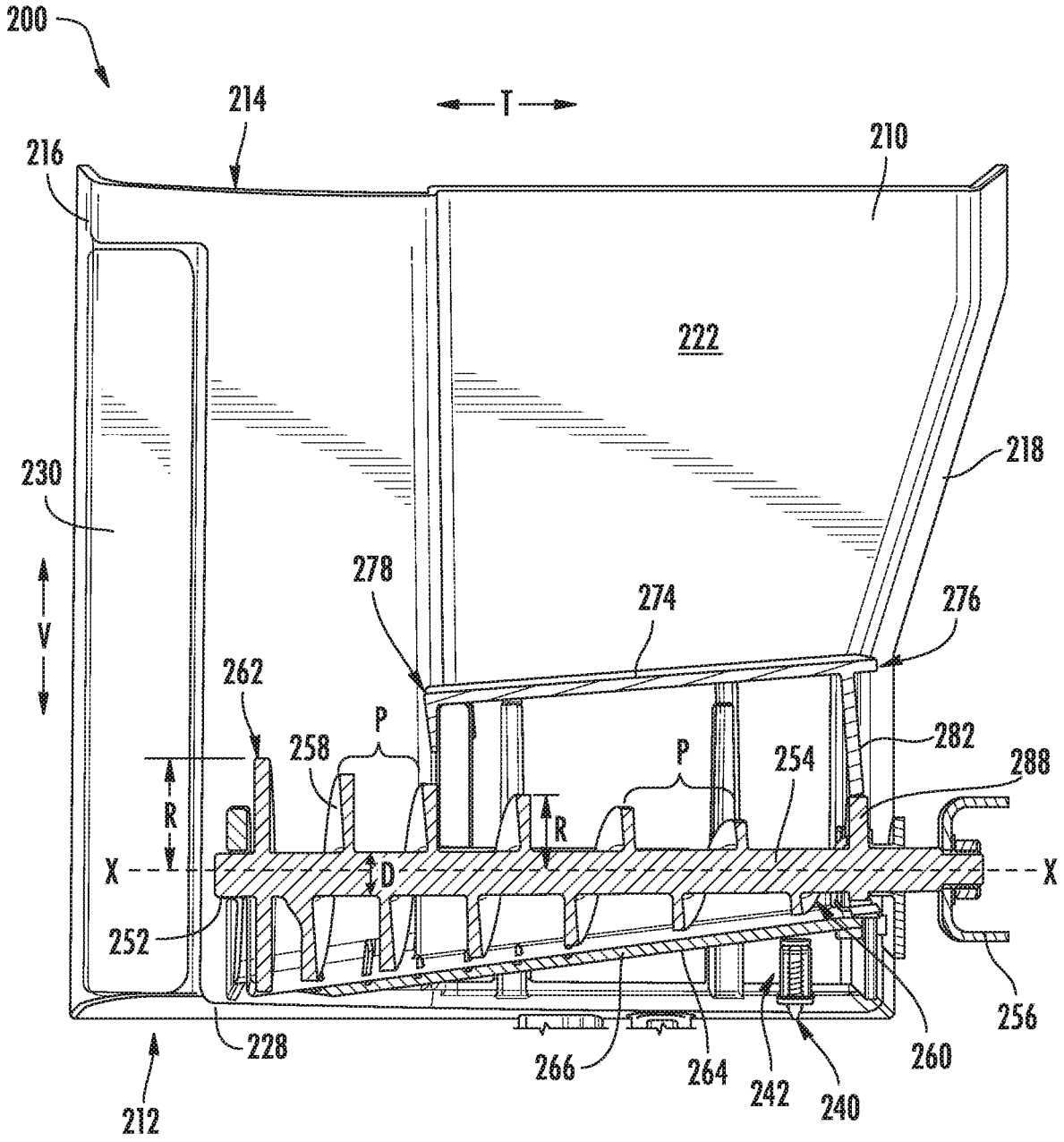
FIG. 5 provides a cross-sectional side view of an exemplary bin assembly.
Figure 6:
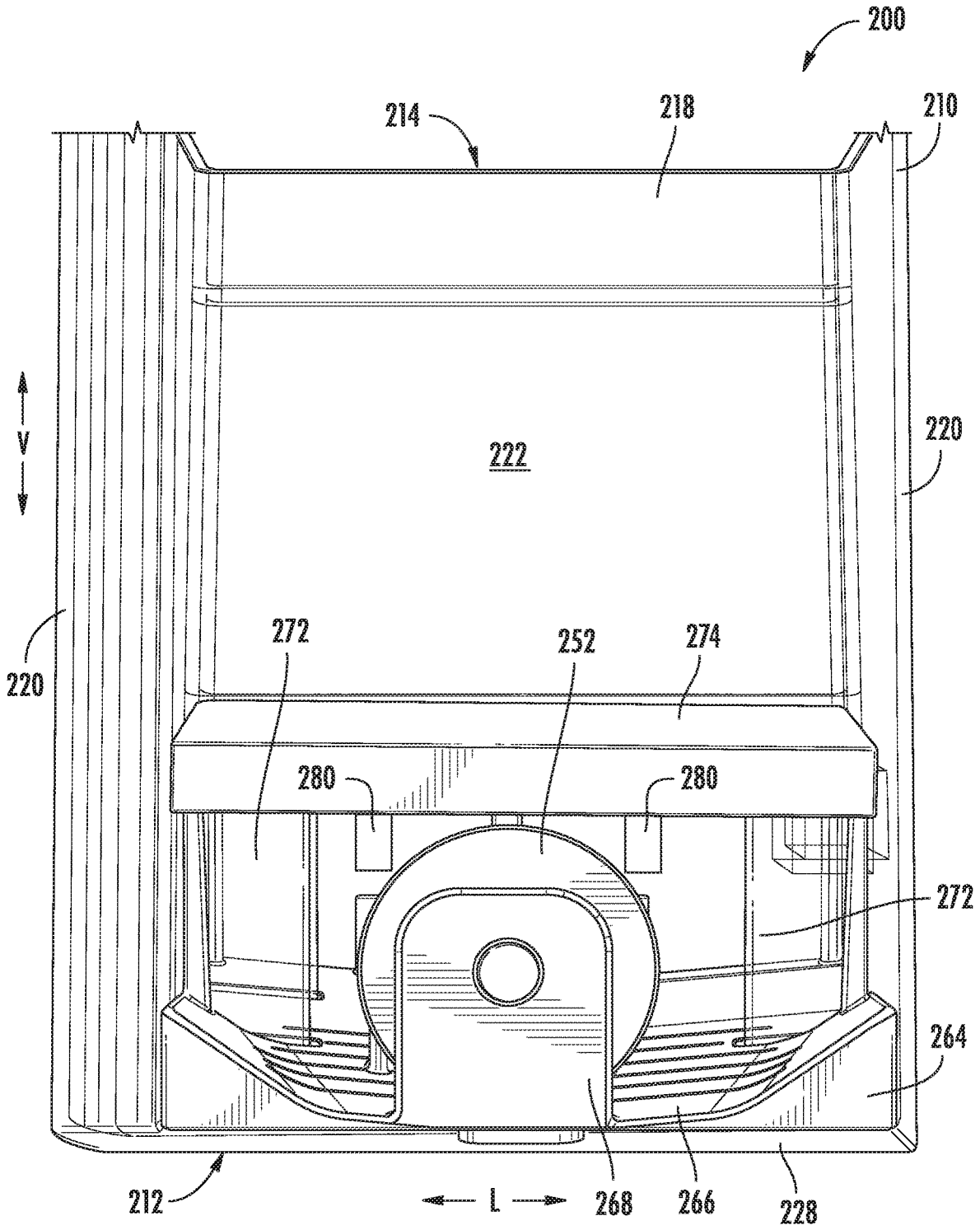
FIG. 6 provides a front cross-sectional view of an exemplary bin assembly.
Figure 7:
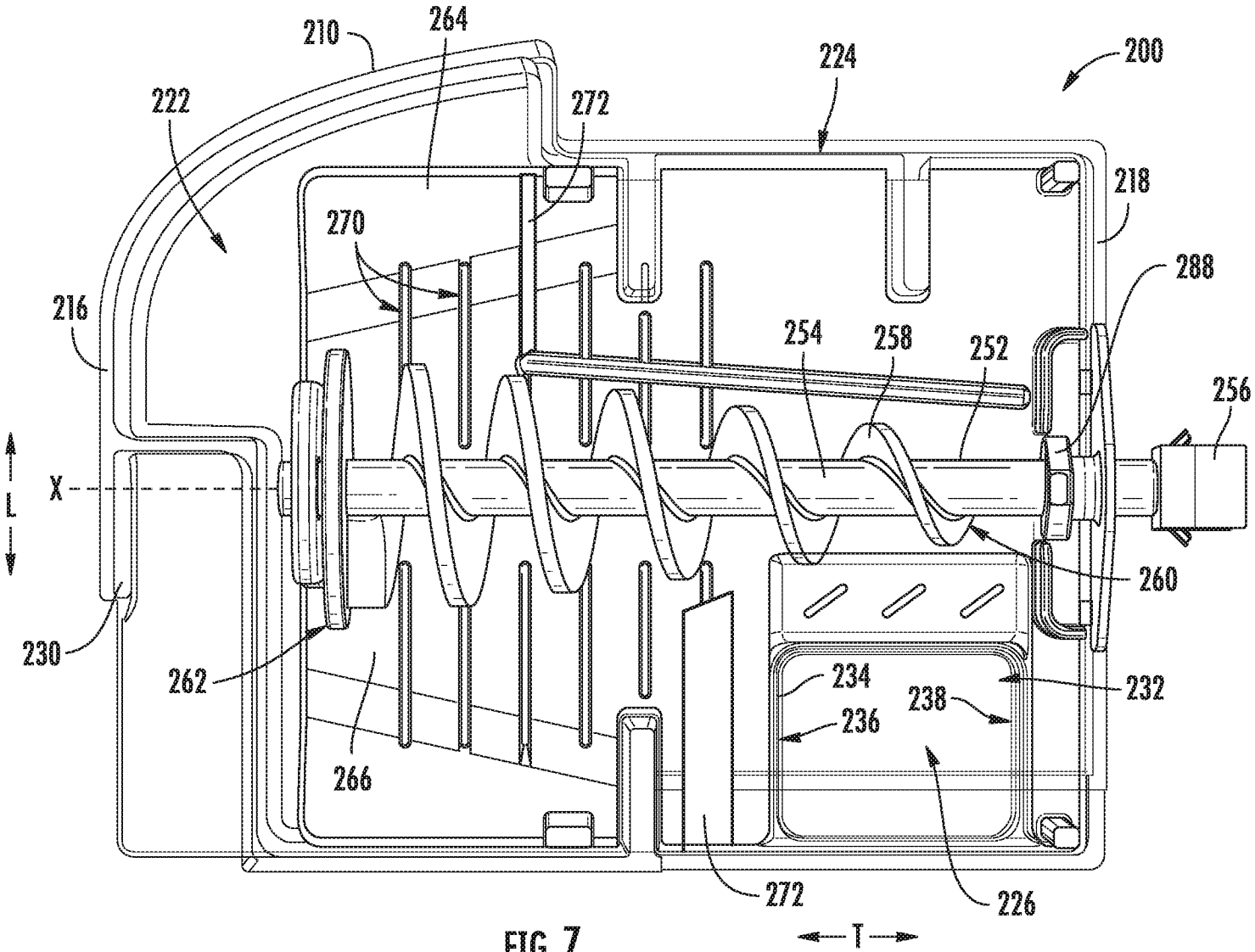
FIG. 7 provides an overhead cross-sectional view of an exemplary bin assembly.

A bin motor 202 may be in mechanical communication with an auger (e.g., non-vertical auger 252—FIG. 4) of ice storage bin 164. In some embodiments, bin motor 202 is mounted to door 128 (e.g., indirectly attached to cabinet 102), as illustrated. In other embodiments, bin motor 202 is mounted within fresh food chamber 122 or freezer chamber 124 (e.g., directly attached to cabinet 102).

In optional embodiments, an access door 166 is hinged to refrigerator door 128. Access door 166 may permit selective access to sub-compartment 162. Any manner of suitable latch 168 is configured with sub-compartment 162 to maintain access door 166 in a closed position. As an example, latch 168 may be actuated by a user in order to open access door 166 for providing access into sub-compartment 162. Access door 166 can also assist with insulating sub-compartment 162 (e.g., by thermally isolating or insulating sub-compartment 162 from fresh food chamber 122). It is noted that although an access door 166 is illustrated in exemplary embodiments, alternative embodiments may be free of any separate access door. For instance, ice storage bin 164 may be immediately visible upon opening door 128.

In certain embodiments, ice making assembly 160 is positioned or disposed within sub-compartment 162. As illustrated, ice making assembly 160 may include a mold body or casing 170. In some such embodiments, auger 172 is rotatably mounted in a mold body within casing 170 (shown partially cutout to reveal auger 172). In particular, a motor 174 may be mounted to casing 170 and in mechanical communication with (e.g., coupled to) auger 172. Motor 174 is configured for selectively rotating auger 172 in the mold body within casing 170. During rotation of auger 172 within the mold body, auger 172 scrapes or removes ice off an inner surface of the mold body within casing 170 and directs such ice to an extruder 175. At extruder 175, ice nuggets are formed from ice within casing 170. An ice bucket or bin assembly 164 may be positioned below extruder 175 and receive the ice nuggets from extruder 175. From ice bin 164, the ice nuggets can enter dispensing assembly 140 and be accessed by a user as discussed above. In such a manner, ice making assembly 160 can produce or generate ice nuggets.

In additional or alternative embodiments, ice making assembly 160 includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice making assembly 160 is air cooled in order to form ice therein.

In exemplary embodiments, ice making assembly 160 includes a heater 180, such as an electric resistance heating element, mounted to casing 170. Heater 180 is configured for selectively heating casing 170 (e.g., when ice prevents or hinders rotation of auger 172 within casing 170).

It is noted that although ice making assembly 160 is illustrated as a nugget ice maker, the present disclosure is not limited to any particular style or configuration for making ice. As is understood by one of ordinary skill, other exemplary embodiments may include an ice making assembly configured to make ice flakes, solid pieces of ice (e.g., cubes or crescents), or any other suitable form of frozen ice.

Operation of refrigerator appliance 100 is generally controlled by a processing device or controller 190. Controller 190 may, for example, be operatively coupled to control panel 148 for user manipulation to select features and operations of refrigerator appliance 100, such as ice bin 164 or ice making assembly 160. Controller 190 can operate various components of refrigerator appliance 100 to execute selected system cycles and features. In exemplary embodiments, controller 190 is in operative communication (e.g., electrical or wireless communication) with ice bin 164, for example, at motor 202. In additional or alternative embodiments, controller 190 is in operative communication with ice making assembly 160 (e.g., at motor 174, fan 176, and heater 180). Thus, controller 190 can selectively activate and operate ice bin 164, motor 174, fan 176, or heater 180.

Controller 190 may include a memory and microprocessor, such as a general or special purpose microprocessor operable to execute programming instructions or micro-control code associated with operation of ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software. One or more portions of ice bin 164, bin motor 202, or ice making assembly 160 may be in communication with controller 190 via one or more signal lines or shared communication busses.

In optional embodiments, ice making assembly 160 also includes a temperature sensor 178. Temperature sensor 178 is configured for measuring a temperature of casing 170 or liquids, such as liquid water, within casing 170. Temperature sensor 178 can be any suitable device for measuring the temperature of casing 170 or liquids therein. For example, temperature sensor 178 may be a thermistor or a thermocouple. Controller 190 can receive a signal, such as a voltage or a current, from temperature sensor 190 that corresponds to the temperature of the temperature of casing 170 or liquids therein. In such a manner, the temperature of casing 170 or liquids therein can be monitored or recorded with controller 190.

Turning now generally to FIGS. 4 through 18, various views are provided of a storage bin assembly 200 according to exemplary embodiments of the present disclosure. Storage bin assembly 200 may be used within and selectively attached to a cabinet 102 of a refrigerator appliance 100 (FIG. 2).

When attached, storage bin assembly 200 may be received within a chilled chamber (e.g., fresh food chamber 122 or freezer chamber 124) of the corresponding refrigerator appliance 100. As an example, storage bin assembly 200 may selectively attach to cabinet 102 at a bracket or support surface fixed within a chilled chamber of refrigerator appliance 100. As another example, storage bin assembly 200 may selectively attach to cabinet 102 at a door 128 of refrigerator appliance 100 (e.g., support surface 192). In exemplary embodiments, storage bin assembly 200 is provided as, or as part of, ice bin 164 (FIG. 3).

As described herein, it is understood that the vertical direction V, lateral direction L, and transverse direction T described within the context of FIGS. 4 through 18 generally correspond to storage bin assembly 200 in isolation. However, these directions may also align with (e.g. be parallel to) the respective vertical direction V, lateral direction L, and transverse direction T defined by refrigerator appliance 100 (FIG. 1) when storage bin assembly 200 is attached cabinet 102 or mounted to a door 128 (FIG. 1) in the closed position.

Storage bin assembly 200 generally includes a bin body 210 extending along the vertical direction V from a bottom end 212 to a top end 214. Bin body 210 may generally be formed as a solid, nonpermeable structure having one or more sidewalls 220 defining a storage volume 222 to receive ice therein (e.g., from ice making assembly 160—FIG. 3).

In certain embodiments, sidewalls 220 include a front wall 216 and a rear wall 218. When bin body 210 is positioned or mounted within sub-compartment 162 (FIG. 3), front wall 216 may generally be positioned forward from rear wall 218. Specifically, rear wall 218 may be positioned proximal to door 128 while front wall 216 is positioned proximal to fresh food compartment 122 (e.g., along the transverse direction T as would be defined when the corresponding door 128 is in the closed position). Optionally, a handle 230 may be provided on front wall 216. For instance, handle 230 may be formed on front wall 216 such that a user grip is defined at a front end of bin body 210. Additionally or alternatively, a suitable handle structure may be mounted to another portion of storage bin assembly 200.

In additional or alternative embodiments, one portion of bin body 210 may be formed from a transparent material, such as a suitable rigid polymer (e.g., acrylic, polycarbonate, etc.), through which a user may view the contents of storage volume 222. For instance, front wall 216 may be a transparent wall formed from the transparent material. Optionally, each sidewall 220 may be a transparent wall formed from the transparent material. Additionally or alternatively, each wall (e.g., 220 and 228) may be integrally-formed with the other walls (e.g., such that bin body 210 is provided as a unitary monolithic member).

At top end 214, bin body 210 generally defines a bin opening 224 through which ice may pass into storage volume 222. Below top end 214 (e.g., at a bottom end 212), bin body 210 may define a dispenser opening 226 through which ice may pass from storage volume 222 (e.g., to dispensing assembly 140—FIG. 1). For example, bin body 210 may include a bottom wall 228 (e.g., attached to or integral with sidewalls 220) that defines dispenser opening 226 in fluid communication with storage volume 222.

Optionally, dispenser opening 226 may be defined as a vertical opening (e.g., parallel to the vertical direction V through bottom wall 228). Thus, dispenser opening 226 may define a horizontal perimeter 232. A perimeter wall 234 may extend vertically about dispenser opening 226 (e.g., from bottom wall 228) and horizontal perimeter 232. Additionally or alternatively, perimeter wall 234 may define at least a portion of horizontal perimeter 232.

Generally, horizontal perimeter 232 defines the horizontal extrema of dispenser opening 226 (e.g., perpendicular to the vertical direction V). In some embodiments, at least two horizontal extrema for the horizontal perimeter 232 are provided as a front edge 236 and a rear edge 238. Generally, front edge 236 is positioned forward from rear edge 238 and rear edge 238 is positioned rearward from front edge 236 (e.g., along or relative to the transverse direction T). Front edge 236 may be defined proximal to front wall 216 and rear edge 238 may be defined proximal to the rear wall 218 (e.g., along the transverse direction T). Additionally or alternatively, dispenser opening 226 may be defined closer to rear wall 218 than front wall 216 (i.e., proximal to rear wall 218 or distal to front wall 216). For instance, the longitudinal distance (e.g., along the transverse direction T) between front edge 236 and front wall 216 may be greater than the longitudinal distance between rear edge 238 and rear wall 218.

In some embodiments, the entirety of top end 214 is open and unobstructed. Top end 214 and bin opening 224 may be free of any lid or enclosing portion. Optionally, bin opening 224 may define a radial or horizontal maximum of storage volume 222 (i.e., the maximum radial or horizontal width of storage volume 222). Advantageously, bin opening 224 may provide easy and direct access to storage volume 222 through which ice may pass. A user may thus easily scoop or pour large amounts ice from storage volume 222 directly through bin opening 224.

In certain embodiments, a drain aperture 240 is defined through bin body 210 (e.g., through bottom wall 228) to permit water therein to flow to another downstream portion of refrigerator appliance 100 (FIG. 2) (e.g., when attached thereto). For instance, drain aperture 240 may be defined by bottom wall 228 at a location that is spaced apart (e.g., horizontally, such as along the lateral direction L) from dispenser opening 226. In optional embodiments, bottom wall 228 is non-horizontal or slanted (e.g., generally downward relative to the vertical direction V) toward drain aperture 240.

In additional or alternative embodiments, storage bin assembly 200 includes a selective sealing system 242 to selectively permit or restrict water from bin body 210. In some embodiments, a resilient or biased sealing plug 244 is paired to drain aperture 240. For instance, biased sealing plug 244 may be slidable along the vertical direction V within drain aperture 240.

Figure 14:
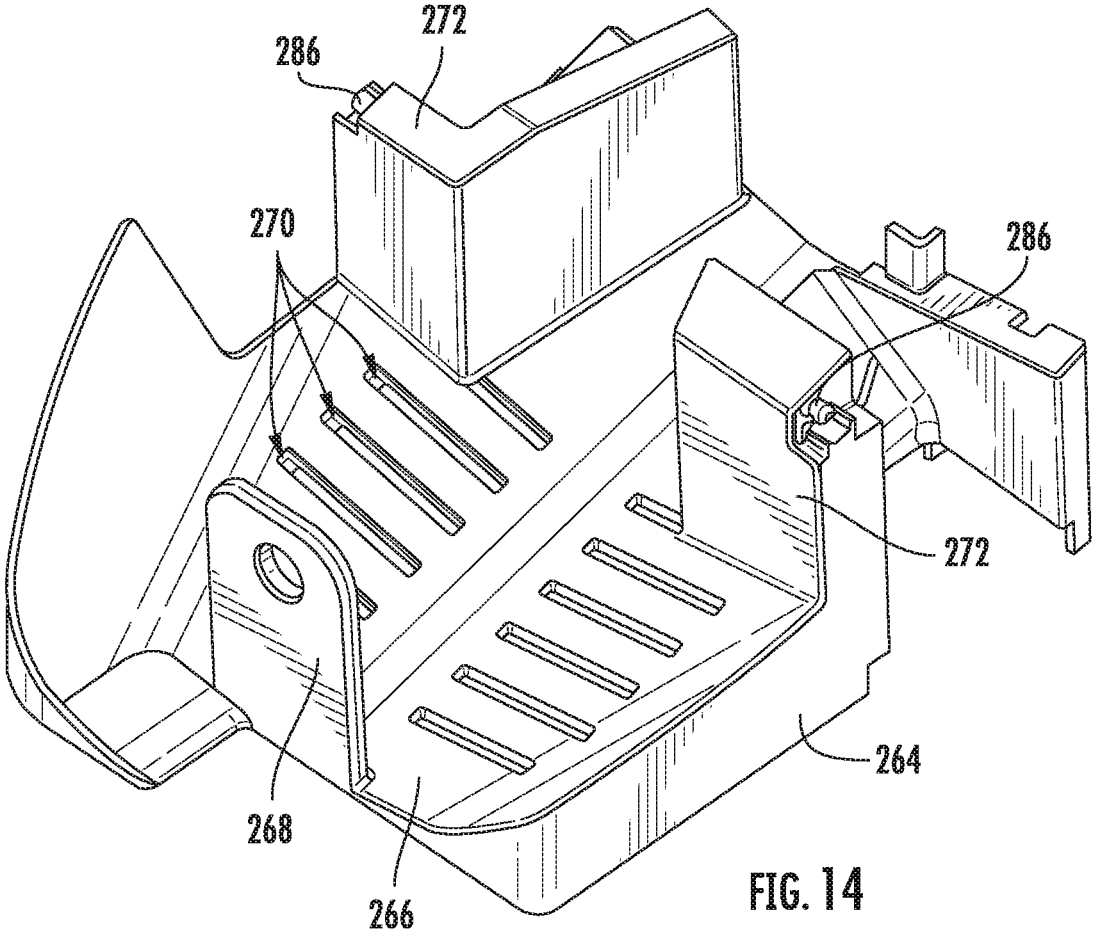
FIG. 14 provides a perspective view of a base platform of an exemplary bin assembly.
Figure 15:
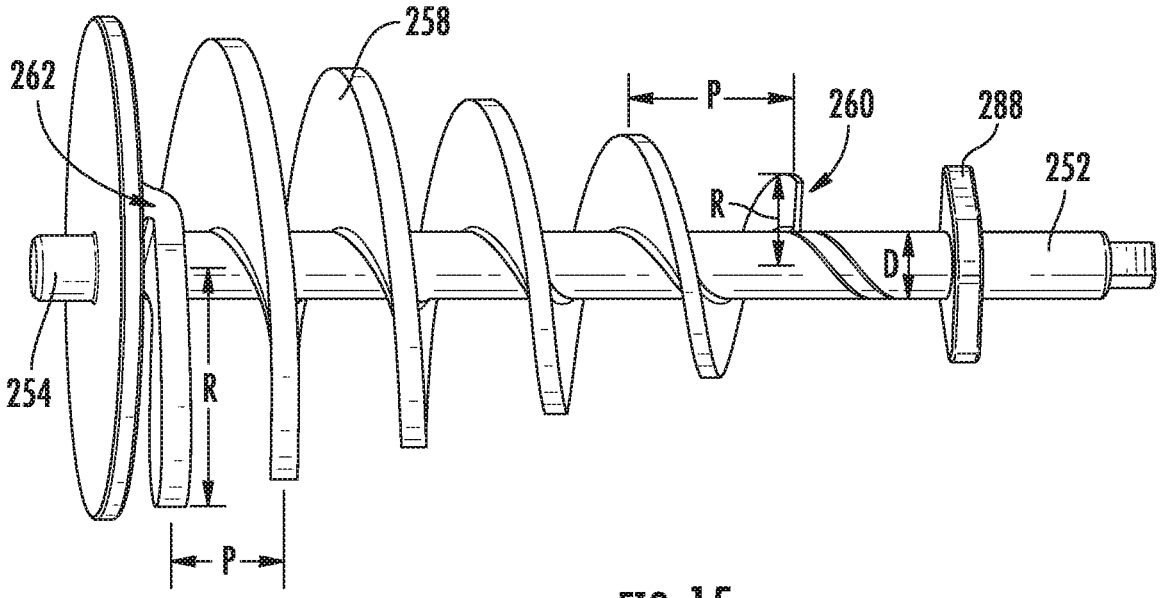
FIG. 15 provides a side view of an auger of an exemplary bin assembly.
Figure 17:
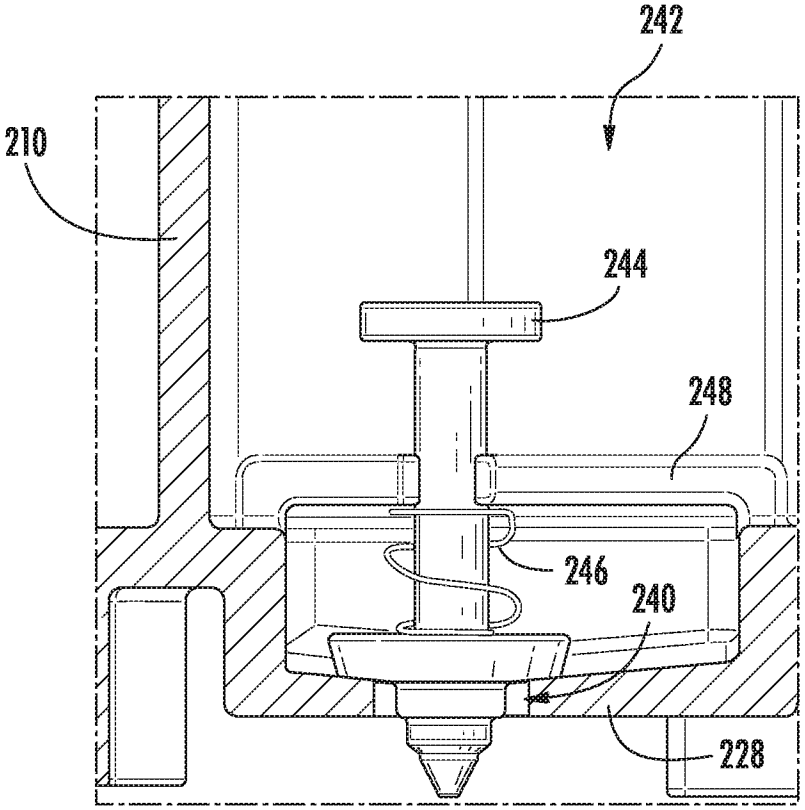
FIG. 17 provides a magnified cross-sectional view of a portion of the exemplary bin assembly in a sealed position.
Figure 16:
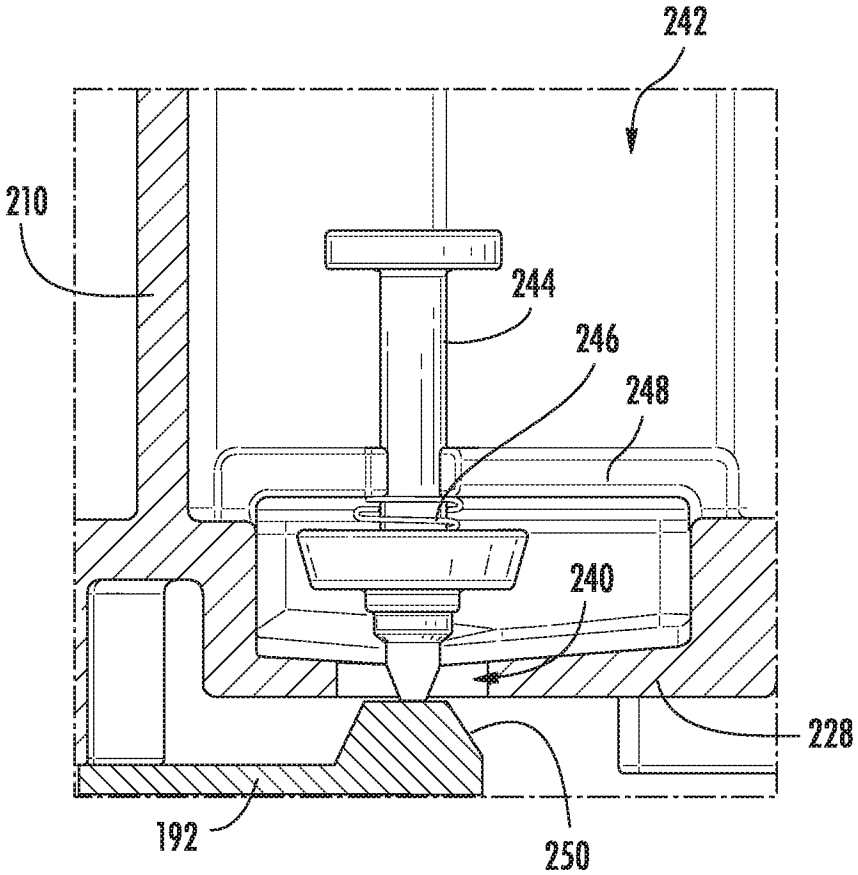
FIG. 16 provides a magnified cross-sectional view of a portion of the exemplary bin assembly in an unsealed position.
Figure 18:
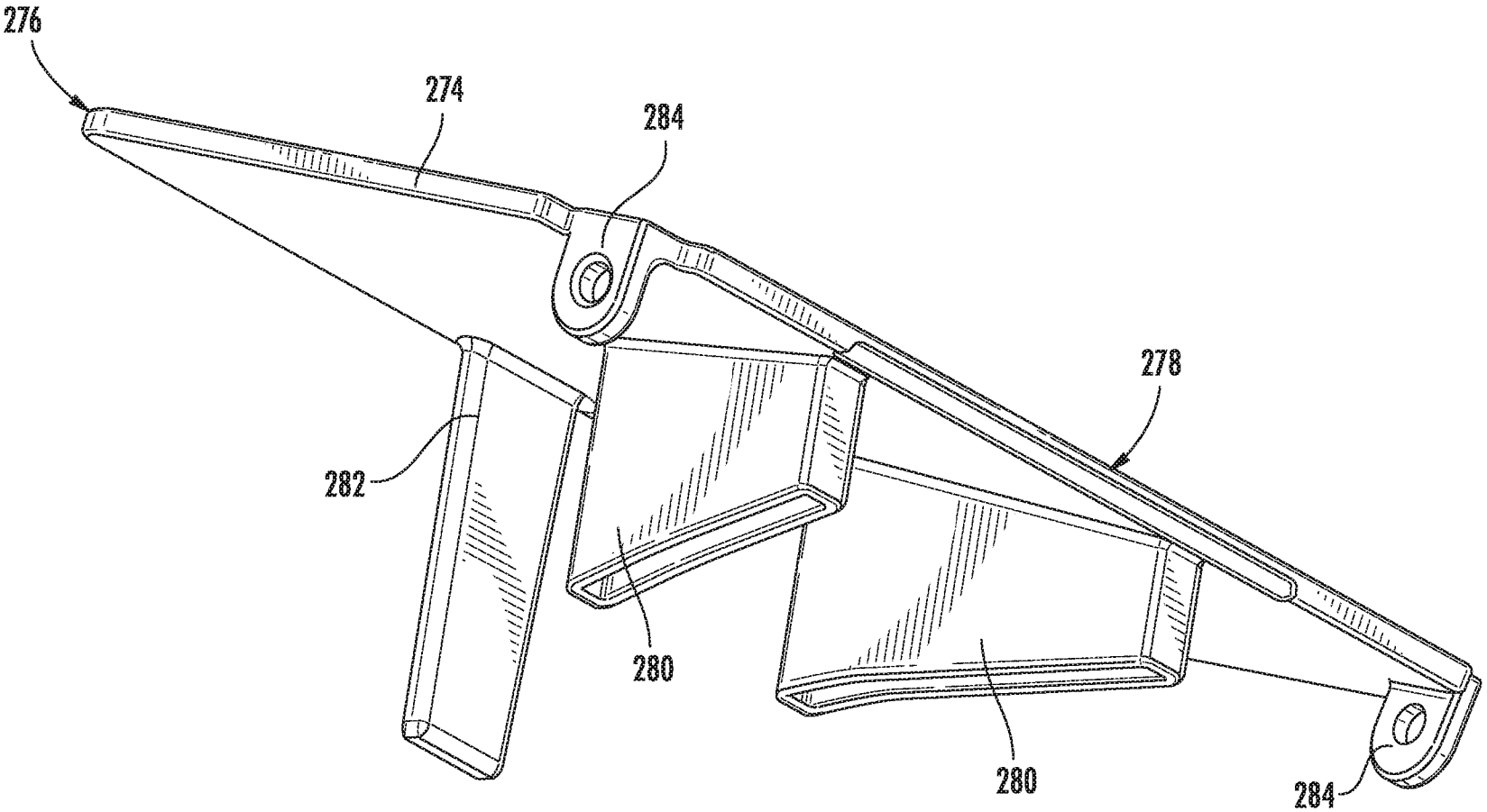
FIG. 18 provides a perspective view of a kick plate of an exemplary bin assembly.

In some embodiments, sealing system 242 selectively fills or blocks drain aperture 240 according to a condition of storage bin assembly 200. For instance, in a fully mounted condition (e.g., wherein storage bin assembly 200 is fully attached to and supported on refrigerator appliance 100—FIG. 2), biased sealing plug 244 may be positioned away from drain aperture 240, as illustrated in FIG. 14. Water may be permitted to freely pass downstream through drain aperture 240. In a non-fully mounted condition, biased sealing plug 244 may extend to or through drain aperture 240, directly engaging a portion of bin body 210 or bottom wall 228, as illustrated in FIG. 17. Water may be substantially prevented or restricted from passing through drain aperture 240.

In certain embodiments, a spring 246 is attached to biased sealing plug 244 in biased engagement. Spring 246 may generally urge biased sealing plug 244 toward drain aperture 240. For instance, spring 246 may be embodied as a compression spring. Spring 246 may be positioned between a support tab 278 and biased sealing plug 244. In some such embodiments, support tab 278 is fixed within bin body 210.

A plug prong 250 may be provided in some embodiments of sealing system 242. For instance, plug prong 250 may be attached to cabinet 102 (FIG. 2) (e.g., at a support surface 192 of door 128). In some such embodiments, a vertical recess or groove is defined below bottom wall 228 to receive plug prong 250. When storage bin assembly 200 is in a mounted condition, plug prong 250 may extend through the vertical recess and contact a distal tip of biased sealing plug 244. Plug prong 250 may thus engage biased sealing plug 244 through drain aperture 240, forcing biased sealing plug 244 toward spring 246 and away from drain aperture 240. When storage bin assembly 200 is positioned away from plug prong 250, such as in a non-mounted condition, plug prong 250 may be disengaged from biased sealing plug 244. Spring 246 may force plug toward drain aperture 240, preventing undesired leaks.

In certain embodiments, a non-vertical auger 252 is provided or mounted (e.g., rotatably mounted) within storage volume 222 to selectively direct ice within the storage volume 222 to the dispenser opening 226. Optionally, non-vertical auger 252 is positioned above bottom wall 228 or dispenser opening 226.

As shown, exemplary embodiments of non-vertical auger 252 include a rotation shaft 254 that extends along a rotation axis X (e.g., perpendicular to the vertical direction V). In the illustrated exemplary embodiments, rotation shaft 254 extends through a sidewall 220 (e.g., rear wall 218) and through at least a portion of storage volume 222. During use, non-vertical auger 252 and rotation shaft 254 can thus selectively rotate within storage volume 222 (e.g., relative to bin body 210).

In certain embodiments, rotation shaft 254 selectively engages bin motor 202 (FIG. 3). For instance, in exemplary embodiments, an adapter key 256 is connected or attached to rotation shaft 254. For instance, a portion of rotation shaft 254 may extend through bin body 210 and support adapter key 256 outside of storage volume 222. In some such embodiments, adapter key 256 is fixed to rotation shaft 254 and rotatable about rotation axis X. When storage bin assembly 200 is attached to refrigerator appliance 100 (e.g., mounted to a door 128—FIG. 3), adapter key 256 may engage bin motor 202 in a horizontal connection beside bin body 210. Adapter key 256 may thus establish mechanical communication between bin motor 202 and non-vertical auger 252. During use, bin motor 202 may motivate rotation of adapter key 256 and rotation shaft 254 about the rotation axis X.

In some embodiments, the horizontal connection between bin motor 202 and rotation shaft 254 permits storage bin assembly 200 to slide horizontally (i.e., perpendicular to the vertical direction V) into attachment with refrigerator appliance 100 (FIG. 3) without requiring any vertical movement or motion of storage bin assembly 200. Advantageously, a user may attach or remove storage bin assembly 200 from refrigerator appliance 100 without lifting storage bin assembly 200 up and over bin motor 202 or, for example, support surface 192 (FIG. 3).

An auger blade 258 may be coiled about rotation shaft 254 and, thus, generally about the rotation axis X. Specifically, auger blade 258 extends radially outward from or relative to rotation shaft 254. As shown, auger blade 258 defines a blade radius R. Blade radius R may define an outer radius or width of non-vertical auger 252 relative to a radial direction perpendicular to the rotation axis X.

Generally, auger blade 258 extends along (e.g., relative to) the rotation axis X from a first blade end 260 to a second blade end 262. First blade end 260 may define one axial extreme of auger blade 258 while second blade end 262 defines an opposite axial extreme. Optionally, the longitudinal or axial length of auger blade 258 may be less than the longitudinal or axial length of rotation shaft 254. Thus, auger blade 258 may extend only upon a sub-portion of the rotation shaft 254 that is less than the whole of rotation shaft 254 (e.g., the whole portion of rotation shaft 254 that is positioned within storage volume 222).

Auger blade 258 may be fixed to rotation shaft 254 such that auger blade 258 and rotation shaft 254 rotate in tandem. For instance, auger blade 258 may be fixed from first blade end 260 to second blade end 262. Optionally, auger blade 258 may be formed integrally (e.g., unitary monolithic element) with rotation shaft 254.

From first blade end 260 to second blade end 262, auger blade 258 may be coiled or wound as a helix in a set direction about the rotation axis X. In other words, auger blade 258 may be formed as a right-handed helix (as pictured) or, alternatively, a left-handed helix from first blade end 260 to second blade end 262. The direction of the auger blade 258 winding may generally correspond to the intended direction of ice movement along the rotation axis X (e.g., rearward from second blade end 262 to first blade end 260 or, alternatively, forward from first blade end 260 to second blade end 262) for ice within storage volume 222. In the illustrated exemplary embodiments, the intended direction of movement for ice is rearward and the auger blade 258 is formed as a right-handed helix from first blade end 260 to second blade end 262.

In some embodiments, first blade end 260 is generally positioned closer to dispenser opening 226 than second blade end 262 (e.g., along or relative to the transverse direction T). In other words, first blade end 260 may be positioned proximal to dispenser opening 226 while second blade end 262 is positioned distal to dispenser opening 226. Rotation of non-vertical auger 252 may thus generally motivate ice toward the first blade end 260 and toward dispenser opening 226.

In additional or alternative embodiments, auger blade 258 terminates above (e.g., directly or indirectly over) at least a portion of dispenser opening 226. For instance, as measured along or relative to the rotation axis X, first blade end 260 may be positioned between front edge 236 and rear edge 238 of dispenser opening 226. Specifically, first blade end 260 may be positioned forward from rear edge 238 and rearward from front edge 236 relative to the rotation axis X. As ice is motivated toward dispenser opening 226 (e.g., by rotation of non-vertical auger 252), the movement of ice that is directly guided or motivated by non-vertical auger 252 may stop above dispenser opening 226 such that ice is permitted to fall from ice storage volume 222 through dispenser opening 226. Advantageously, ice motivated by non-vertical auger 252 may be prevented from being packed or compressed against a sidewall 220 or over dispenser opening 226 (e.g., such that dispenser opening 226 is obstructed by ice clumps).

As noted above, auger blade 258 defines a blade radius R perpendicular to the rotation axis X. In some embodiments, blade radius R is provided as an expanding radius from first blade end 260 to second blade end 262. Thus, the radial width or blade radius R may increase from first blade end 260 to second blade end 262 (e.g., as would be measured along the rotation axis X). In some such embodiments, the blade radius R defines a frusto-conical profile between first blade end 260 and second blade end 262. In additional or alternative embodiments, a shaft diameter D of rotation shaft 254 (e.g., perpendicular to rotation axis X) does not increase from first blade end 260 to second blade end 262. For instance, shaft diameter D may remain constant (as pictured) or generally decrease along the rotation axis X from first blade end 260 to second blade end 262.

In exemplary embodiments, the increase of blade radius R (e.g., angle of expansion relative to the rotation axis X) is constant from first blade end 260 to second blade end 262. In alternative embodiments (not shown), the increase of blade radius R is variable from first blade end 260 to second blade end 262.

As shown, auger blade 258 defines multiple turns between which a blade pitch P is generally defined. In optional embodiments, blade pitch P is variable between first blade end 260 and second blade end 262 (e.g., as would be measured along the rotation axis X). In other words, the longitudinal or axial distance between adjacent turns of auger blade 258 may be different between one (e.g., first) adjacent pair of turns and another (e.g., second) adjacent pair of turns. In exemplary embodiments, the blade pitch P is a variable pitch that decreases from first blade end 260 to second blade end 262. Thus, the variable pitch may increase along the rotation axis X from second blade end 262 to first blade end 260. In some such embodiments, the increase in blade pitch P is constant (i.e., a constant rate of increase relative to longitudinal distance from second blade end 262).

In additional or alternative embodiments, the increase in blade pitch P from second blade end 262 to first blade end 260 is proportional to the increase in blade radius R from first blade end 260 to second blade end 262. An equal or identical volume may optionally be defined between each pair of adjacent turns of auger blade 258 from first blade end 260 to second blade end 262.

Advantageously, a set volume of ice may be motivated by non-vertical auger 252 and may be prevented from being packed or compressed (e.g., before exiting storage volume 222 through dispenser opening 226).

Figure 10:
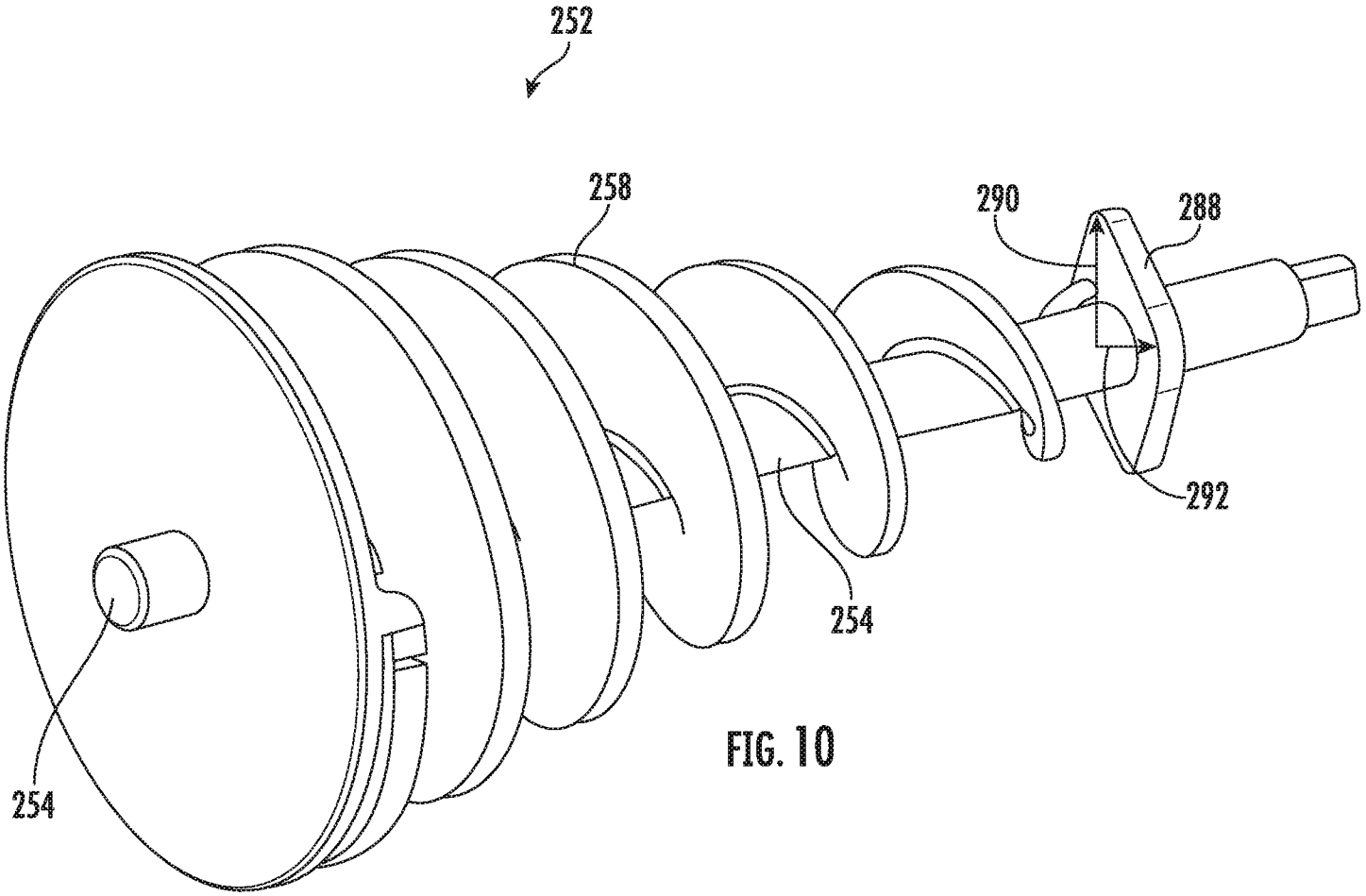
FIG. 10 provides a perspective view of an auger of an exemplary bin assembly.
Figure 11:
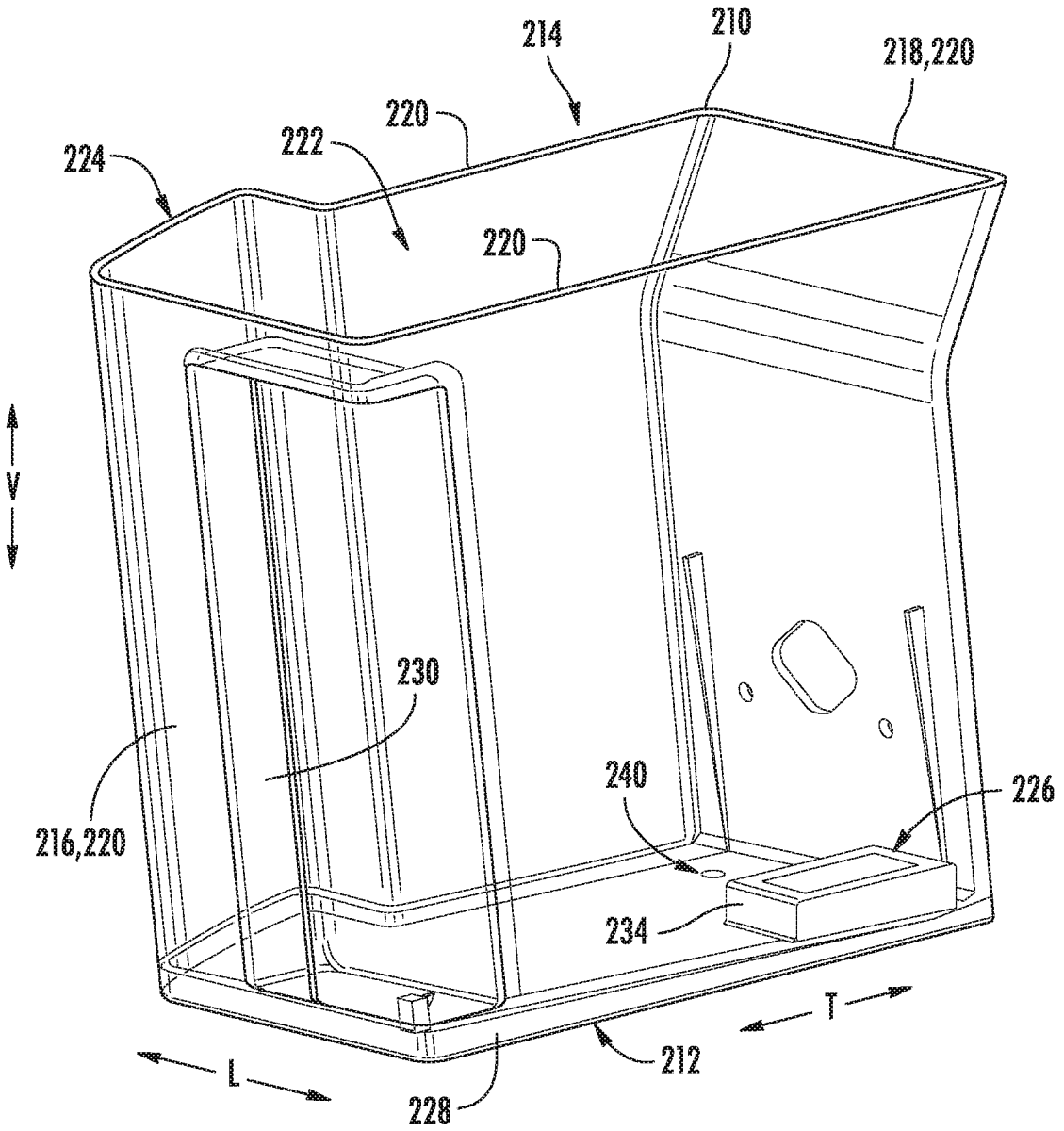
FIG. 11 provides a perspective view of a bin body of an exemplary bin assembly.
Figure 12:
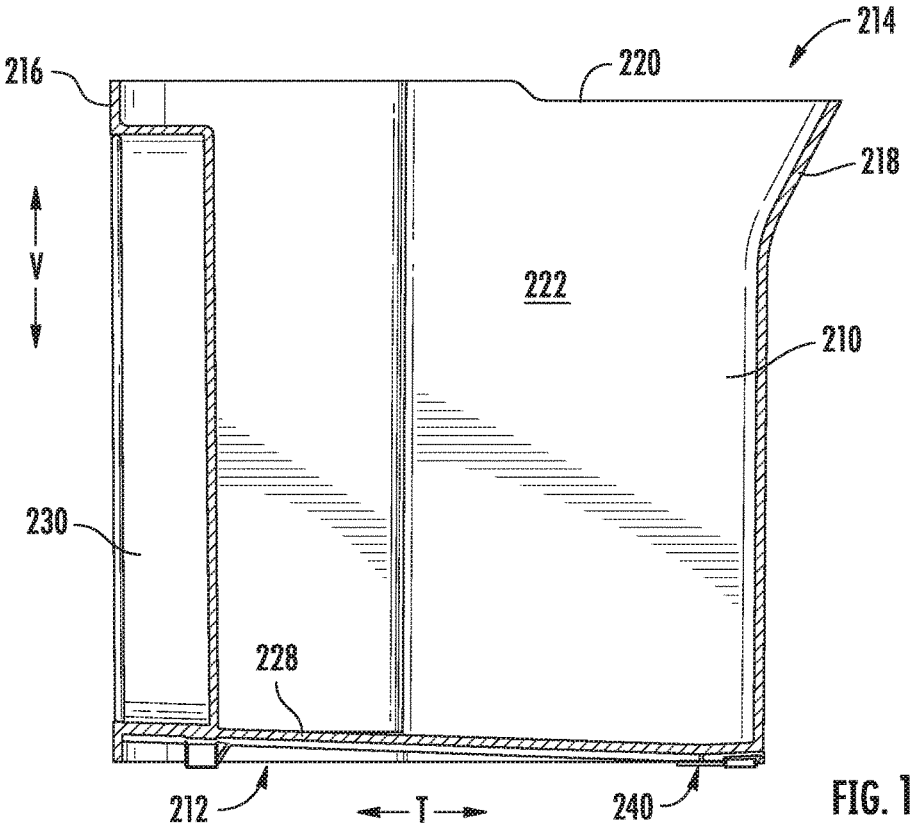
FIG. 12 provides a side cross-sectional view of an exemplary bin body.
Figure 13:
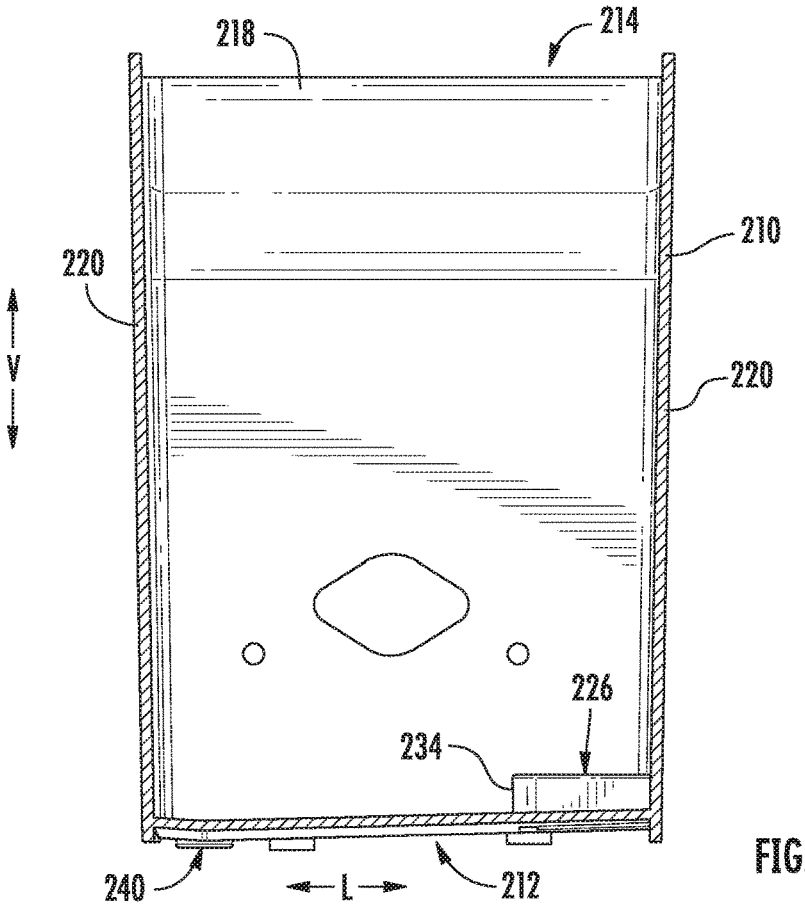
FIG. 13 provides a front cross-sectional view of the exemplary bin body.

Some embodiments may include a cam 288 on the rotation shaft 254 of non-vertical auger 252. The cam 288 may be fixed to rotation shaft 254 such that cam 288 and rotation shaft 254 rotate in tandem. The cam 288 may be positioned rearward of the first blade end 260 on the rotation shaft 254. When the storage bin assembly 200 is in a fully assembled position or configuration, e.g., with the non-vertical auger 254 mounted or installed within the storage volume 222, the cam 288 on the non-vertical auger 252 may be located proximate or adjoining the rear wall 218. The cam 288 may define a variable radius perpendicular to the rotation axis X. For example, the cam 288 may include a major radius 290 and a minor radius 292. The major radius 290 is generally larger than the minor radius 292. The major and minor radii 290 and 292 may be circumferentially spaced apart from each other by about ninety degrees. Thus, as the rotation shaft 254 turns, the cam 288 will travel between a high position, e.g., as shown in FIG. 10, where the major radius 290 is oriented generally along the vertical direction V, and a low position where the minor radius 292 is oriented generally along the vertical direction V.

In certain embodiments, a base platform 264 is provided within storage volume 222. For instance, base platform 264 may be mounted on bottom wall 228 to guide or direct at least a portion of ice within storage volume 222. In some such embodiments, base platform 264 includes a floor 266 on which ice may be supported within storage volume 222. When assembled, floor 266 may be positioned below rotation shaft 254 or auger blade 258. Additionally or alternatively, a support post 268 may be provided to support non-vertical auger 252 (e.g., proximal to second blade end 262).

In additional or alternative embodiments, at least a portion of base platform 264 is matched to the expanding blade radius R of auger blade 258. For instance, floor 266 may decrease in vertical height between the first blade end 260 and the second blade end 262. In some such embodiments, floor 266 defines a complementary shape (e.g., negative profile) to the shape defined by auger blade 258. Notably, base platform 264 may guide ice (e.g., upward) toward non-vertical auger 252 as the ice is motivated by non-vertical auger 252 within storage volume 222.

In exemplary embodiments, base platform 264 (e.g., at floor 266) defines one or more melt apertures 270 through which liquid from melted ice may pass (e.g., to separate liquid water from solid ice). Generally, melt apertures 270 are defined to have a set cross-sectional area that is smaller than ice (e.g., cubes or nuggets) to be formed by icemaker. Optionally, melt apertures 270 are in fluid communication with drain aperture 240. As ice melts, the liquid water may thus pass through melt apertures 270 and generally flow to drain aperture 240. The remaining ice, by contrast, may be held above drain aperture 270 and on base platform 264.

In optional embodiments, one or more internal bounding walls 272 are provided adjacent to non-vertical auger 252. For instance, a pair of internal bounding walls 272 may be provided on base platform 264 within storage volume 222. As shown, in exemplary embodiments, the pair of internal bounding walls 272 may be positioned at opposite radial sides of a portion of the auger blade 258 (e.g., at a location between the first blade end 260 and the second blade end 262 along the rotation axis X).

It is noted that although internal bounding walls 272 are shown as extending on or directly from base platform, additional or alternative embodiments can include one or more bounding walls 272 extending from another portion of storage bin assembly 200. As an example, one or more bounding walls 272 may extend directly from (e.g., attached to or integral with) one or more sidewalls 220. As another example, one or more bounding walls 272 may extend directly from (attached to or integral with) a kick plate 274.

In some embodiments, the pair of internal bounding walls 272 is positioned forward from first blade end 260 and rearward from second blade end 262. Optionally, the pair of internal bounding walls 272 may extend from an internal surface of opposite sidewalls 220 (e.g., perpendicular to the rotation axis X). Additionally or alternatively, one or both bounding walls 272 may define a complementary shape (e.g., negative profile) to the shape defined by auger blade 258.

As non-vertical auger 252 rotates within storage volume 222, the internal bounding walls 272 may block or halt movement of a peripheral ice (e.g., ice outward from the blade radius R) and notably prevent ice from compressing at or adjacent to dispenser opening 226.

In additional or alternative embodiments, a kick plate 274 is mounted or held within ice storage volume 222 above rotation shaft 254 or auger blade 258. As shown, kick plate 274 is spaced apart from rotation axis X. When assembled, kick plate 274 may extend (e.g., along the transverse direction T or rotation axis X) from a wall end 276 to a free end 278. Optionally, kick plate 274 may extend inward from at least one sidewall 220 (e.g., at wall end 276 from rear wall 218) and halt or terminate before spanning the entirety of storage volume 222. For instance, a free end 278 of the kick plate 274 may be spaced apart (e.g., along the transverse direction T or rotation axis X) from front wall 216 such that a vertical gap is formed or defined between front wall 216 and kick plate 274.

In some embodiments, one or more upper bounding walls 280 extend generally along the vertical direction V (e.g., downward) from an underside of kick plate 274. For instance, a pair of upper bounding walls 280 may be positioned at opposite radial sides of a portion of the auger blade 258 (e.g., at a location between the first blade end 260 and the second blade end 262 along the rotation axis X). Additionally or alternatively, the pair of upper bounding walls 280 may be positioned at the free end 278 and further extend rearward therefrom (e.g., toward wall end 276).

In optional embodiments, at least a portion of kick plate 274 is slanted downward. For instance, the vertical height of kick plate 274 may generally decrease from wall end 276 to free end 278. In some such embodiments, the vertical height may decrease between first blade end 260 and second blade end 262 (e.g., as would be measured along the rotation axis X). In additional or alternative embodiment, free end 278 is located directly above a portion of blade auger between first blade end 260 and second blade end 262. Another portion of intermediate wall may further be positioned directly above dispenser opening 226. During use, kick plate 274 may generally direct ice downward and away from dispenser opening 226 to a portion of non-vertical auger 252. Advantageously, kick plate 274 may prevent excessive ice from accumulating within dispenser opening 226.

In some embodiments, the kick plate 274 may be hingedly mounted within the storage volume 222. For example, the kick plate 274 may include a pair of loops 284 at the free end 278 thereof, and the loops 284 of the kick plate 274 may each a receive pin 286 therein to form a hinge which defines a pivot axis about which the kick plate 274 may rotate. The pins 286 may, in some embodiments, be formed on the base platform 264, such as on the internal bounding walls 272 thereof.

Figure 8:
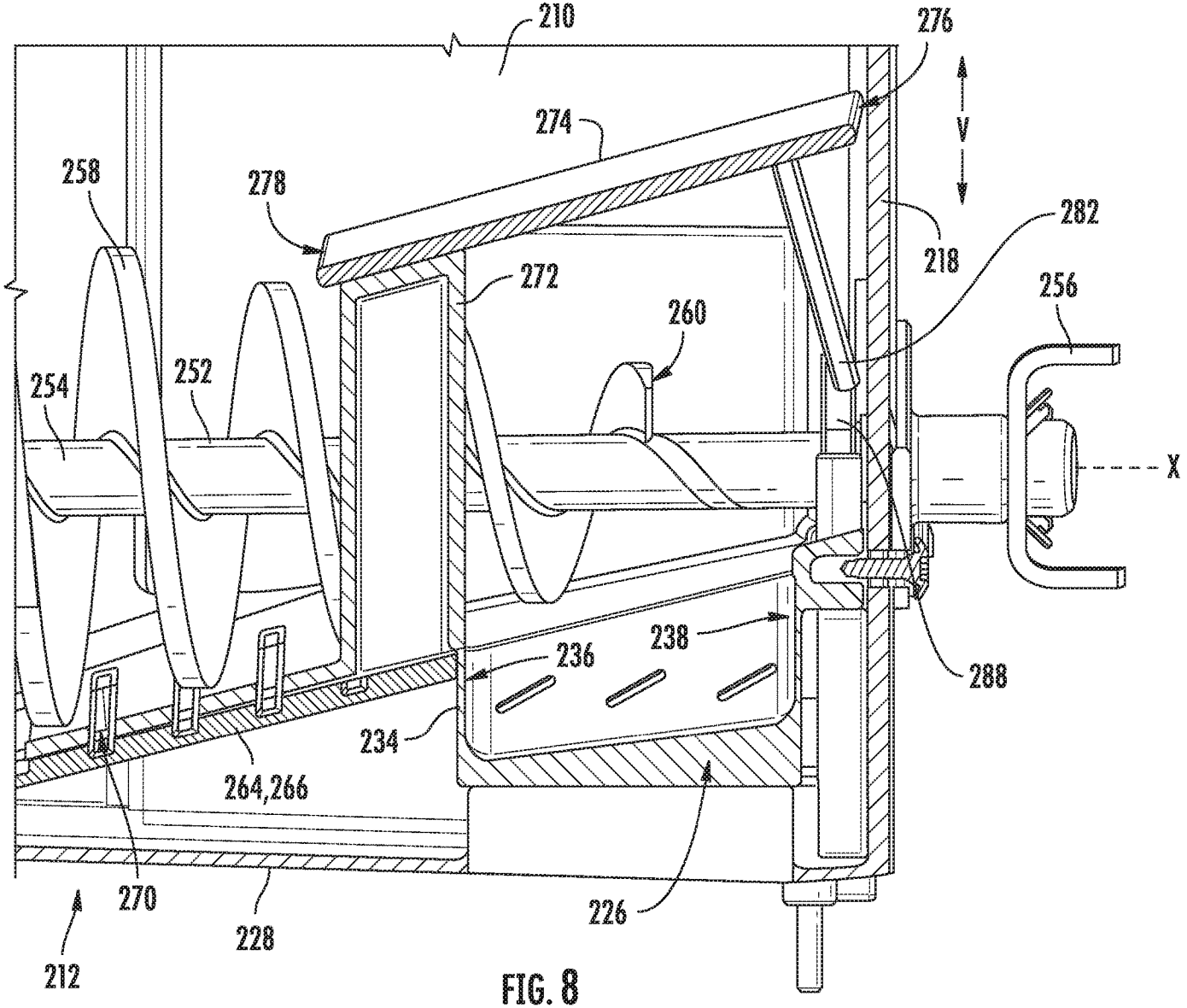
FIG. 8 provides a magnified, side cross-sectional view of a portion of an exemplary bin assembly.
Figure 9:
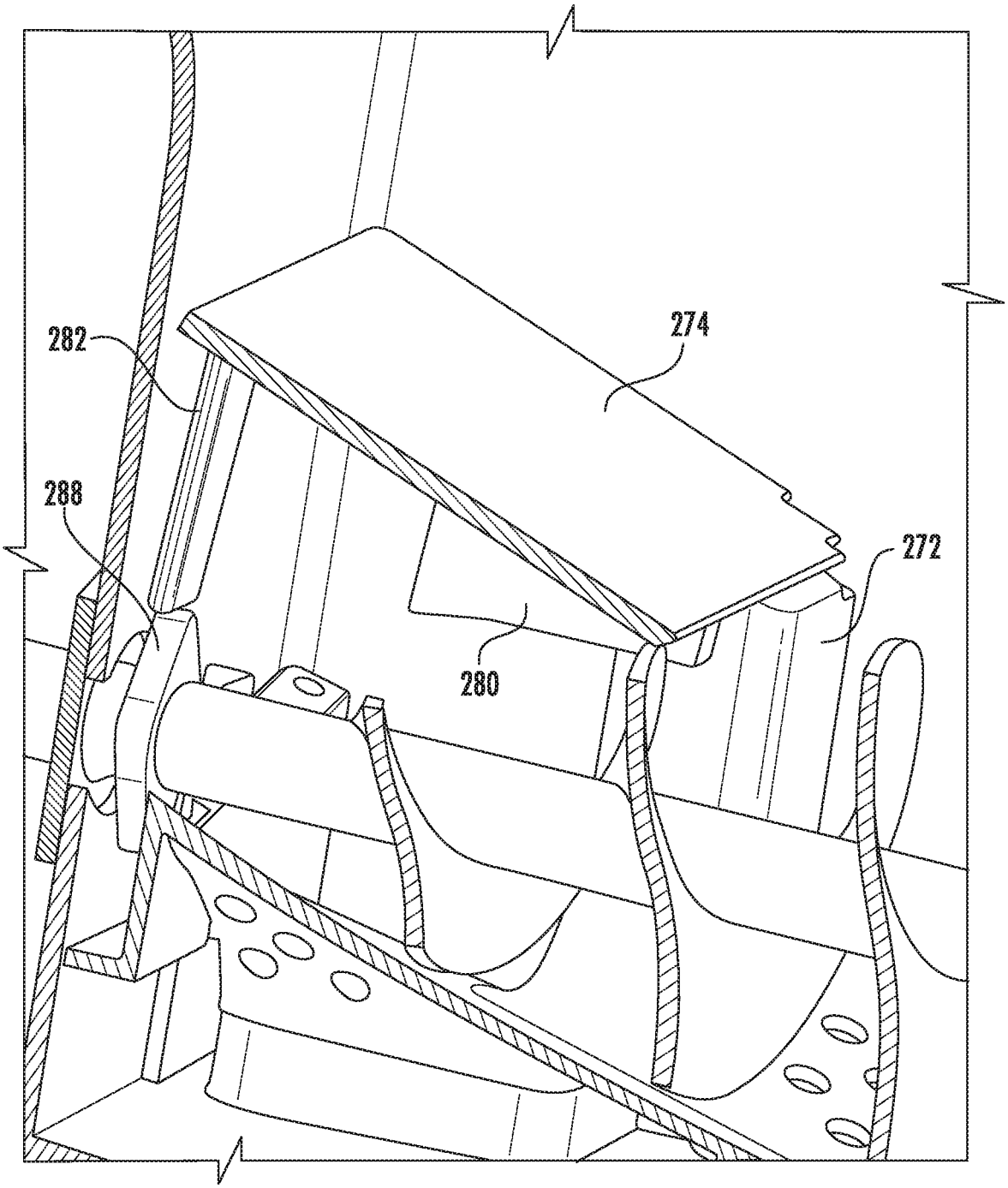
FIG. 9 provides a magnified view of a portion of an exemplary bin assembly.

The kick plate 274 may also include a finger 282 extending downward along the vertical direction V from the underside of the kick plate 274 at the wall end 276 of the kick plate 274. The finger 282 of the kick plate 274 may contact, e.g., rest on, the cam 288 of the non-vertical auger 252. For example, the finger 282 of the kick plate 274 may be seen resting on the cam 288 while the cam 288 is in the high position in FIG. 9. The cam 288 of the non-vertical auger may thereby actuate the kick plate 274. When the non-vertical auger 252 rotates and the cam 288 resultingly move from the high position to the low position (while also travelling through a series of intermediate positions between the high position and the low position, one of which is illustrated in FIG. 8), the kick plate 274 will thereby drop and rise with each rotation of the non-vertical auger 252. For example, as noted above, the major radius 290 and the minor radius 292 may be circumferentially spaced apart by ninety degrees. Further, the cam 288 may be symmetrical, e.g., the major radius 290 may be one half of a major diameter and the minor radius 292 may be one half of a minor radius of the cam 288. Thus, for each full three hundred sixty degree rotation of the non-vertical auger 252, the kick plate 274 may drop and rise four times (rise twice and drop twice). Such movement of the kick plate 274 may advantageously contribute to motivation of ice nuggets (or cubes, etc.) within the storage volume 222 towards the non-vertical auger 252. For example, the major radius 290 of the cam 288 may be sufficiently larger than the minor radius 292 and/or the transition between the major radius 290 and the minor radius 292 around the circumference of the cam 288 may be sufficiently abrupt that the kick plate 274 may drop forcefully, that is, with sufficient force for at least partially breaking up or loosening clumps of ice nuggets, e.g., which may have partially melted and re-frozen into a clump or other mass.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, the refrigerator appliance comprising:

a cabinet defining a chilled chamber;

a door rotatable between an open position permitting access to the chilled chamber and a closed position restricting access to the chilled chamber; and an ice bin removably received within the chilled chamber, the ice bin comprising:

a bin body defining a storage volume to receive ice therein, the bin body extending along the vertical direction between a top end and a bottom end, the bin body further defining a dispenser opening in fluid communication with the storage volume at the bottom end to selectively permit ice therefrom;

a non-vertical auger defining a rotation axis within the storage volume to direct ice within the storage volume to the dispenser opening, the non-vertical auger comprising a rotation shaft extending along the rotation axis and a cam disposed on the rotation shaft, the cam extending continuously around an entire circumference of the rotation shaft, the cam defining a major radius and a minor radius; and a kick plate extending from a wall end to a free end, the wall end of the kick plate positioned closer to a rear wall of the ice bin than the free end, the kick plate hingedly mounted within the storage volume at the free end of the kick plate, wherein the cam of the non-vertical auger raises the kick plate along the vertical direction as the cam rotates from a low position where the minor radius is aligned with the vertical direction to a high position where the major radius is aligned with the vertical direction and the cam drops the kick plate along the vertical direction as the cam rotates from the high position to the low position, whereby the cam actuates the kick plate.

2. The refrigerator appliance of claim 1, wherein the kick plate comprises a finger at the wall end of the kick plate, the finger in contact with the cam.

3. The refrigerator appliance of claim 1, wherein the kick plate is mounted within the storage volume above non-vertical auger, and wherein the kick plate is supported by the cam.

4. The refrigerator appliance of claim 1, wherein the major radius and the minor radius are circumferentially spaced apart by about ninety degrees.

5. The refrigerator appliance of claim 1, wherein the non-vertical auger of the ice bin further comprises an auger blade coiled about the rotation shaft, and wherein the cam is disposed rearward of the auger blade on the rotation shaft.

6. The refrigerator appliance of claim 5, wherein the auger blade defines an expanding radius along the rotation axis from a first blade end to a second blade end, the first blade end being positioned proximal to the dispenser opening, and the second blade end being positioned distal to the dispenser opening.

7. The refrigerator appliance of claim 6, wherein the auger blade defines a variable pitch increasing along the rotation axis from the second blade to the first blade end.

8. The refrigerator appliance of claim 1, wherein the bin body comprises a bottom wall at the bottom end, wherein the bottom wall defines a drain aperture spaced apart from the dispenser opening, and wherein the bottom wall is slanted toward the drain aperture.

9. The refrigerator appliance of claim 1, further comprising a base platform positioned below the kick plate within the storage volume to support ice therein, the base platform defining a melt aperture through which melted ice may pass.

10. An ice bin for a refrigerator appliance, the refrigerator appliance defining a vertical direction, the refrigerator appliance comprising a cabinet defining a chilled chamber, a door rotatable between an open position permitting access to the chilled chamber and a closed position restricting access to the chilled chamber, the ice bin configured to be removably received within the chilled chamber, the ice bin comprising:

a bin body defining a storage volume to receive ice therein, the bin body extending along the vertical direction between a top end and a bottom end, the bin body further defining a dispenser opening in fluid communication with the storage volume at the bottom end to selectively permit ice therefrom;

a non-vertical auger defining a rotation axis within the storage volume to direct ice within the storage volume to the dispenser opening, the non-vertical auger comprising a rotation shaft extending along the rotation axis and a cam disposed on the rotation shaft, the cam extending extends continuously around an entire circumference of the rotation shaft, the cam defining a major radius and a minor radius; and a kick plate extending from a wall end to a free end, the wall end of the kick plate positioned closer to a rear wall of the ice bin than the free end, the kick plate hingedly mounted within the storage volume at the free end of the kick plate, wherein the cam of the non-vertical auger raises the kick plate along the vertical direction as the cam rotates from a low position where the minor radius is aligned with the vertical direction to a high position where the major radius is aligned with the vertical direction and the cam drops the kick plate along the vertical direction as the cam rotates from the high position to the low position, whereby the cam actuates the kick plate.

11. The ice bin of claim 10, wherein the kick plate comprises a finger at the wall end of the kick plate, the finger in contact with the cam.

12. The ice bin of claim 10, wherein the kick plate is mounted within the storage volume above non-vertical auger, and wherein the kick plate is supported by the cam.

13. The ice bin of claim 10, wherein the major radius and the minor radius are circumferentially spaced apart by about ninety degrees.

14. The ice bin of claim 10, wherein the non-vertical auger of the ice bin further comprises an auger blade coiled about the rotation shaft, and wherein the cam is disposed rearward of the auger blade on the rotation shaft.

15. The ice bin of claim 14, wherein the auger blade defines an expanding radius along the rotation axis from a first blade end to a second blade end, the first blade end being positioned proximal to the dispenser opening, and the second blade end being positioned distal to the dispenser opening.

16. The ice bin of claim 15, wherein the auger blade defines a variable pitch increasing along the rotation axis from the second blade to the first blade end.

17. The ice bin of claim 10, wherein the bin body comprises a bottom wall at the bottom end, wherein the bottom wall defines a drain aperture spaced apart from the dispenser opening, and wherein the bottom wall is slanted toward the drain aperture.

18. The ice bin of claim 10, further comprising a base platform positioned below the kick plate within the storage volume to support ice therein, the base platform defining a melt aperture through which melted ice may pass.

* * * * *